US011814860B1

(12) United States Patent
Huf et al.

(10) Patent No.: US 11,814,860 B1
(45) Date of Patent: Nov. 14, 2023

(54) DEPLOYABLE AND STOWABLE ROOF STRUCTURES FOR PORTABLE SHELTERS, AND ASSOCIATED METHODS

(71) Applicant: ARDISAM, INC., Cumberland, WI (US)

(72) Inventors: Alexandra Huf, Woodbury, MN (US); Cynthia Nesgoda, Rice Lake, WI (US); Michael Furseth, Cumberland, WI (US)

(73) Assignee: ARDISAM, INC., Cumberland, WI (US)

( * ) Notice: Subject to any disclaimer, the term of this patent is extended or adjusted under 35 U.S.C. 154(b) by 0 days.

(21) Appl. No.: 17/934,523

(22) Filed: Sep. 22, 2022

(51) Int. Cl.
*E04H 15/42* (2006.01)
*E04H 15/64* (2006.01)
*E04H 15/58* (2006.01)

(52) U.S. Cl.
CPC ..... *E04H 15/42* (2013.01); *E04H 15/58* (2013.01); *E04H 15/64* (2013.01)

(58) Field of Classification Search
CPC ..... E04H 15/48; E04H 15/42; E04H 15/64
USPC ..... 135/144, 147
See application file for complete search history.

(56) References Cited

U.S. PATENT DOCUMENTS

| | | | | |
|---|---|---|---|---|
| 1,502,898 A | | 7/1924 | Berg | |
| 1,846,496 A | * | 2/1932 | Mills | E04H 15/28 135/147 |
| 2,113,118 A | * | 4/1938 | Pyatt | E04H 15/28 135/147 |
| 2,953,145 A | | 9/1960 | Moss et al. | |
| 3,266,503 A | | 8/1966 | Hoiness et al. | |
| 3,327,723 A | | 6/1967 | Burgin | |
| 3,865,123 A | | 2/1975 | Bracken | |
| 4,066,089 A | | 1/1978 | Rainwater | |

(Continued)

FOREIGN PATENT DOCUMENTS

| | | |
|---|---|---|
| CN | 102535945 A | 7/2012 |
| CN | 211691769 U | 10/2020 |
| KR | 20090045701 A | 5/2009 |

OTHER PUBLICATIONS

HABO HABO, "Tent with Hub—Six-Sided Tent with Accessories", available at https://www.aliexpress.com/i/4000340662867.html; exact publication date unknown, web page visited Sep. 12, 2020.

(Continued)

*Primary Examiner* — Noah Chandler Hawk
(74) *Attorney, Agent, or Firm* — Perkins Coie LLP

(57) ABSTRACT

A shelter system may include a roof structure with a hub structure, a plurality of roof pole structures connectable to the hub structure and positionable to extend outwardly from the hub structure, and a fabric panel configured to be at least partially suspended from the roof pole structures. The fabric panel may include a reversible pocket. The roof structure is configurable between a stowed configuration and a deployed configuration. When the roof structure is in the stowed configuration, the hub structure and at least a portion of each roof pole structure may be positioned in the reversible pocket. When the roof structure is in the deployed configuration, the hub structure may be positioned above or outside of the reversible pocket. The shelter system may further include a rainfly that is positionable over the fabric panel with a gap between the rainfly and the fabric panel for airflow.

29 Claims, 15 Drawing Sheets

(56) References Cited

U.S. PATENT DOCUMENTS

| | | | | |
|---|---|---|---|---|
| 4,239,247 | A | 12/1980 | Hinz | |
| 4,585,020 | A | 4/1986 | Masuda et al. | |
| 4,938,243 | A | 7/1990 | Foster | |
| 4,941,499 | A * | 7/1990 | Pelsue | E04H 15/42 135/156 |
| 5,046,882 | A | 9/1991 | Ju | |
| 5,271,423 | A | 12/1993 | Eychaner | |
| 5,749,387 | A | 5/1998 | Thompson | |
| 5,884,646 | A * | 3/1999 | Ju | E04H 15/64 135/147 |
| 6,089,247 | A | 7/2000 | Price | |
| 6,216,717 | B1 | 4/2001 | Chen | |
| 6,666,223 | B2 | 12/2003 | Price et al. | |
| 6,776,179 | B1 | 8/2004 | Chen | |
| 6,868,858 | B2 | 3/2005 | Suh | |
| 7,168,439 | B2 | 1/2007 | Patel et al. | |
| 7,357,140 | B2 | 4/2008 | Chu et al. | |
| 7,607,447 | B1 | 10/2009 | Han | |
| 7,640,942 | B2 | 1/2010 | Chu | |
| 7,703,469 | B2 | 4/2010 | Danziger | |
| 7,845,364 | B2 | 12/2010 | Tolmie | |
| 8,056,573 | B2 | 11/2011 | Panigot | |
| 8,079,380 | B2 | 12/2011 | Engstrom et al. | |
| 8,746,179 | B2 | 6/2014 | Farmer et al. | |
| 8,776,816 | B2 | 7/2014 | Danziger | |
| 9,340,992 | B2 | 5/2016 | Huang | |
| 9,506,269 | B2 | 11/2016 | Armstrong et al. | |
| 9,644,387 | B2 | 5/2017 | Makos et al. | |
| 9,976,318 | B2 * | 5/2018 | Lynch | E04H 15/40 |
| 10,058,181 | B2 | 8/2018 | Makos | |
| 10,306,995 | B2 * | 6/2019 | Swanson | E04H 15/54 |
| 10,612,265 | B1 | 4/2020 | Walter | |
| 10,676,955 | B1 | 6/2020 | Tufto et al. | |
| 11,428,023 | B2 | 8/2022 | Furseth et al. | |
| 2006/0238005 | A1 | 10/2006 | Walter et al. | |
| 2007/0051399 | A1 | 3/2007 | Jung | |
| 2010/0126546 | A1 | 5/2010 | Chen | |
| 2011/0297201 | A1 * | 12/2011 | Chen | E04H 15/42 135/144 |
| 2012/0186619 | A1 | 7/2012 | Makos | |
| 2013/0008478 | A1 | 1/2013 | Prieto Estebanez | |
| 2014/0109945 | A1 | 4/2014 | Jin | |
| 2014/0130837 | A1 | 5/2014 | Sy-facunda | |
| 2014/0202509 | A1 | 7/2014 | Schamberger et al. | |
| 2015/0068573 | A1 * | 3/2015 | Jin | E04H 15/46 135/147 |
| 2015/0275541 | A1 * | 10/2015 | Lamke | E04H 15/46 135/139 |
| 2016/0010357 | A1 | 1/2016 | Makos et al. | |
| 2017/0339941 | A1 | 11/2017 | Burchfield | |
| 2021/0332607 | A1 | 10/2021 | Goldszer et al. | |
| 2021/0396037 | A1 | 12/2021 | Furseth et al. | |
| 2022/0136276 | A1 | 5/2022 | Furseth et al. | |
| 2022/0205270 | A1 | 6/2022 | Jerry et al. | |

OTHER PUBLICATIONS

Houzz, "Outsunny 13'×13' Adjustable Height Pop Up Canopy Party Tent with Easy Setup", URL: https://www.houzz.com/products/outsunny-13-x-13-adjustabIe-height-pop-up-canopy-party-tent-with-easy-setup-prvw-vr~87130317; web page visited Dec. 7, 2020

* cited by examiner

DEPLOYABLE AND STOWABLE ROOF STRUCTURES FOR PORTABLE SHELTERS, AND ASSOCIATED METHODS

BACKGROUND

Conventional portable shelters, such as tents, blinds, or gazebos, may include a roof with a central hub and several support poles extending from the central hub to support a covering material. These shelters often have several drawbacks. For example, they may require cumbersome assembly processes and mechanisms, they may be insufficiently equipped to protect the interior from rain, and they may lack adequate airflow and ventilation. Aspects of embodiments of the present technology address these and other drawbacks.

SUMMARY

Representative embodiments of the present technology include a shelter system with a roof structure that includes a hub structure, a plurality of roof pole structures connectable to the hub structure and positionable to extend outwardly from the hub structure, and a fabric panel configured to be at least partially suspended from the roof pole structures. The fabric panel may include a pocket, which may be a reversible pocket. The roof structure is configurable between a stowed configuration and a deployed configuration. In some embodiments, when the roof structure is in the stowed configuration, the hub structure and at least a portion of each roof pole structure may be positioned in the pocket. In some embodiments, when the roof structure is in the deployed configuration, the hub structure may be positioned above or outside of the pocket. The shelter system may further include a rainfly that is positionable over the fabric panel with a gap between the rainfly and the fabric panel for airflow.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to deployable and stowable roof structures for portable shelters, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail to avoid unnecessarily obscuring the relevant description of the various embodiments. Accordingly, embodiments of the present technology may include additional elements or exclude some of the elements described below with reference to FIGS. 1-9, which illustrate examples of the technology.

The terminology used in this description is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Further, unless otherwise specified, terms such as "attached" or "connected" are intended to include integral connections, as well as connections between physically separate components.

Figure 1:
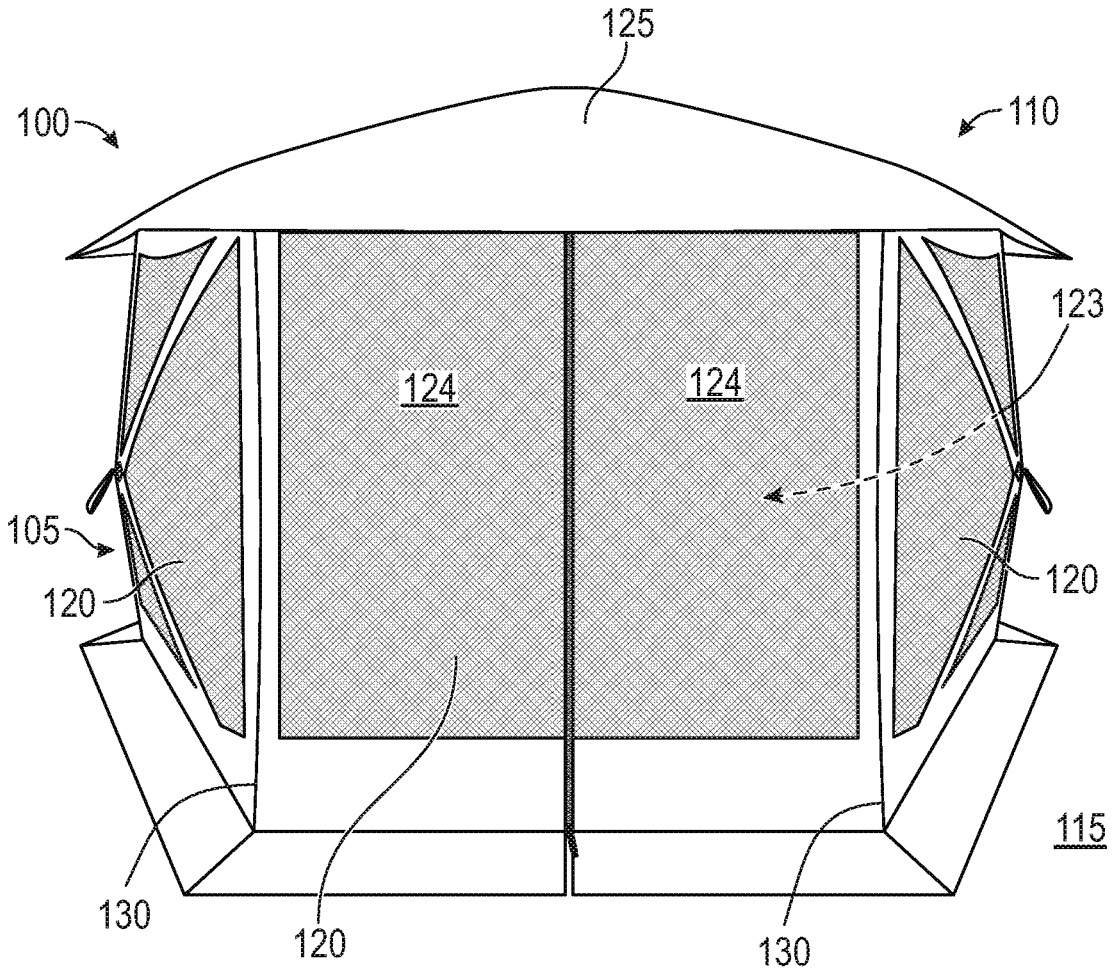
FIG. 1 illustrates a partially schematic perspective view of a shelter configured in accordance with embodiments of the present technology.

FIG. 1 illustrates a partially schematic perspective view of a shelter 100 configured in accordance with embodiments of the present technology. In FIG. 1, the shelter 100 is in a deployed (in use) configuration. In some embodiments, the shelter 100 may include a base structure 105 that supports a roof structure 110 above a ground surface 115. In some embodiments, the base structure 105 includes a plurality of walls 120 (such as six walls 120, only three of which are visible in FIG. 1). The base structure 105 may at least partially enclose a generally hollow interior region 123.

The walls 120 may include panels 124 of flexible material, such as fabric mesh or another suitable material, which may be perforated to facilitate ventilation. In some embodiments, the base structure 105 may include a frame structure 130 that supports the walls 120. In FIG. 1, the frame structure 130 is shown partially schematically as including a plurality of vertical frame members. The frame structure 130 may be positioned inside or outside the walls 120. In some embodiments, one or more of the walls 120 (such as all the walls 120) may be omitted. Accordingly, the base structure 105 may include any suitable structure that holds the roof structure 110 above the ground surface 115, for example, to provide occupiable space in the shelter 100.

In some embodiments, the roof structure 110 includes a rainfly 125. The rainfly 125 may include any suitable top cover. In some embodiments, the rainfly 125 aids in shedding water from the shelter 100 while allowing ventilation between the rainfly 125 and the remainder of the shelter 100, as described below.

Figure 2:
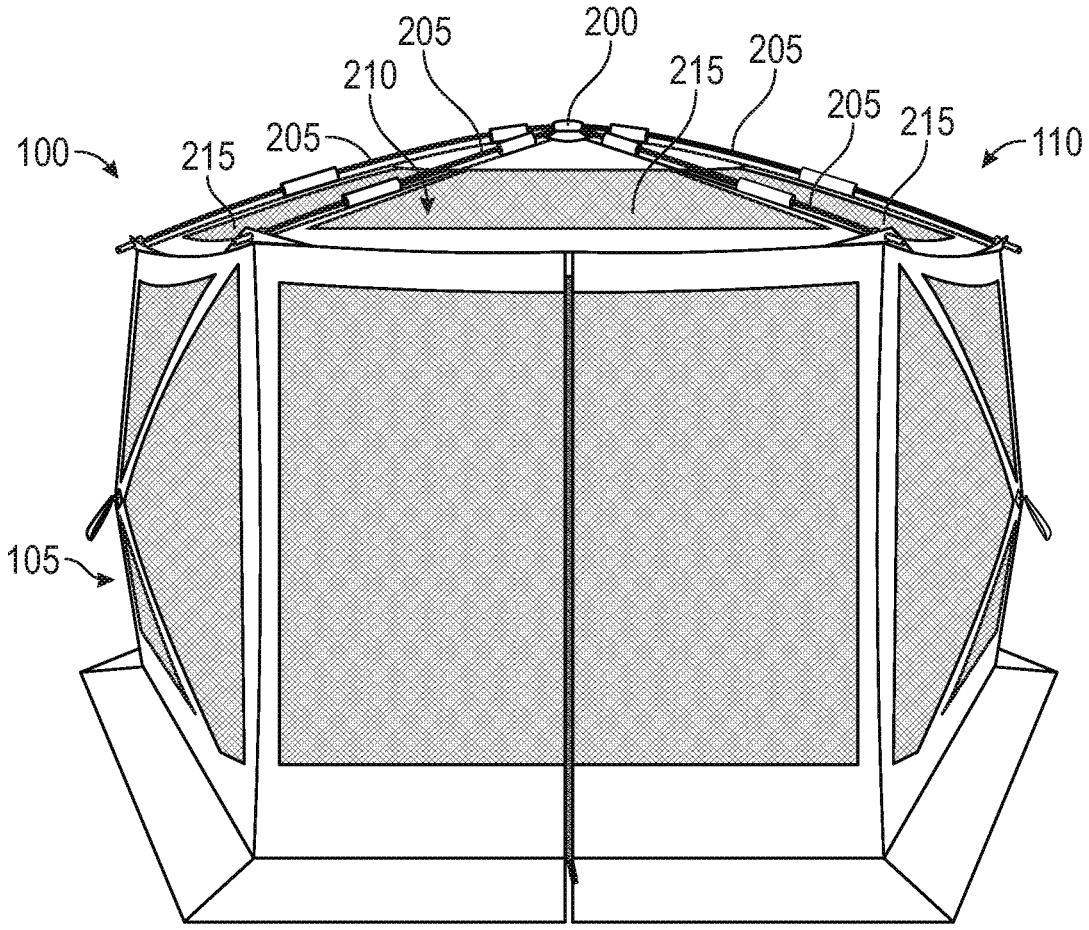
FIG. 2 illustrates a partially schematic perspective view of a configuration of the shelter shown in FIG. 1, in which an optional top cover ("rainfly") is removed.

FIG. 2 illustrates a partially schematic perspective view of the shelter 100 shown in FIG. 1, with the rainfly 125 removed. With the rainfly 125 removed, other components of the shelter 100 are visible. For example, in some embodiments, the roof structure 110 includes a hub structure 200, a plurality of roof pole structures 205 (for example, six roof pole structures 205), and a roof panel 210. The roof pole structures 205 are attached to the hub structure and extend radially outwardly from the hub structure 200 toward a perimeter of the roof structure 110. The roof pole structures 205 may be connected to the roof panel 210. For example, the roof panel 210 may be suspended from the roof pole structures 205. The roof pole structures 205 may be at least partially flexible. The roof pole structures 205 apply tension to the roof panel 210 in a manner that supports the overall roof structure 110. The roof panel 210 may include any suitable flexible material, such as a fabric mesh or a fabric without mesh openings. In some embodiments, the roof panel 210 includes one or more roof panel portions 215 that are attached together to form a single roof panel 210.

Figure 3A:
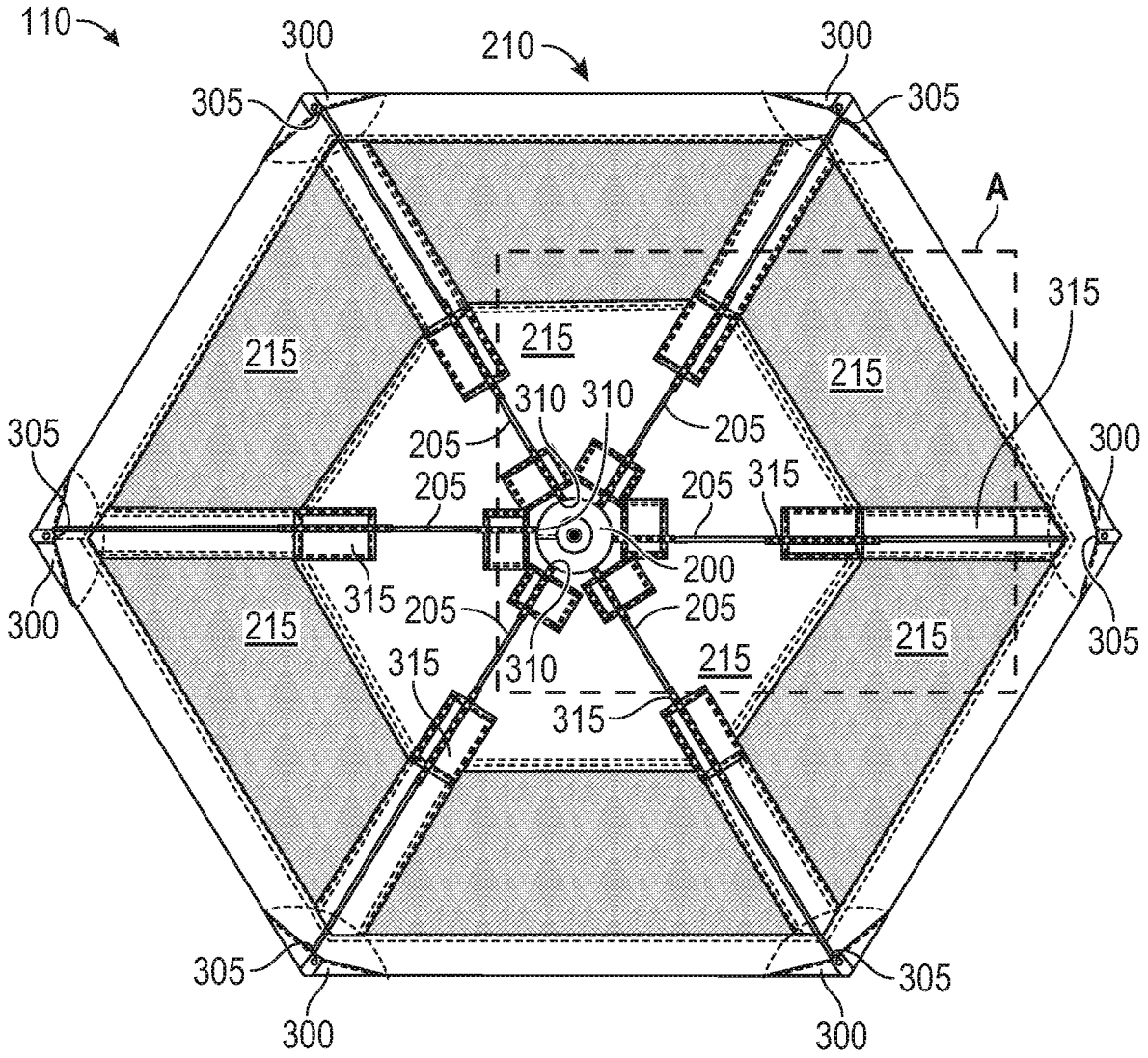
FIG. 3A illustrates a partially schematic top view of the roof structure shown in FIGS. 1 and 2, without the optional rainfly.

FIG. 3A illustrates a partially schematic top view of the roof structure 110 shown in FIGS. 1 and 2, without the rainfly 125. In FIG. 3A, the roof structure 110 is in a deployed (in use) configuration. The one or more roof panel portions 215 may include mesh material, non-mesh material, or a combination of mesh and non-mesh material. In some embodiments, the roof structure 110 includes a plurality of perimeter supports 300 (for example, corner supports) positioned to receive radially outward ends 305 of the roof pole structures 205. Radially inward ends 310 of the roof pole structures 205 may be attached to the hub structure 200 in any manner capable of providing support to the roof pole structures 205, such that the roof pole structures 205 span between the perimeter supports 300 and the hub structure 200. The roof pole structures 205 and the hub structure 200 support the roof panel 210.

Figure 3B:
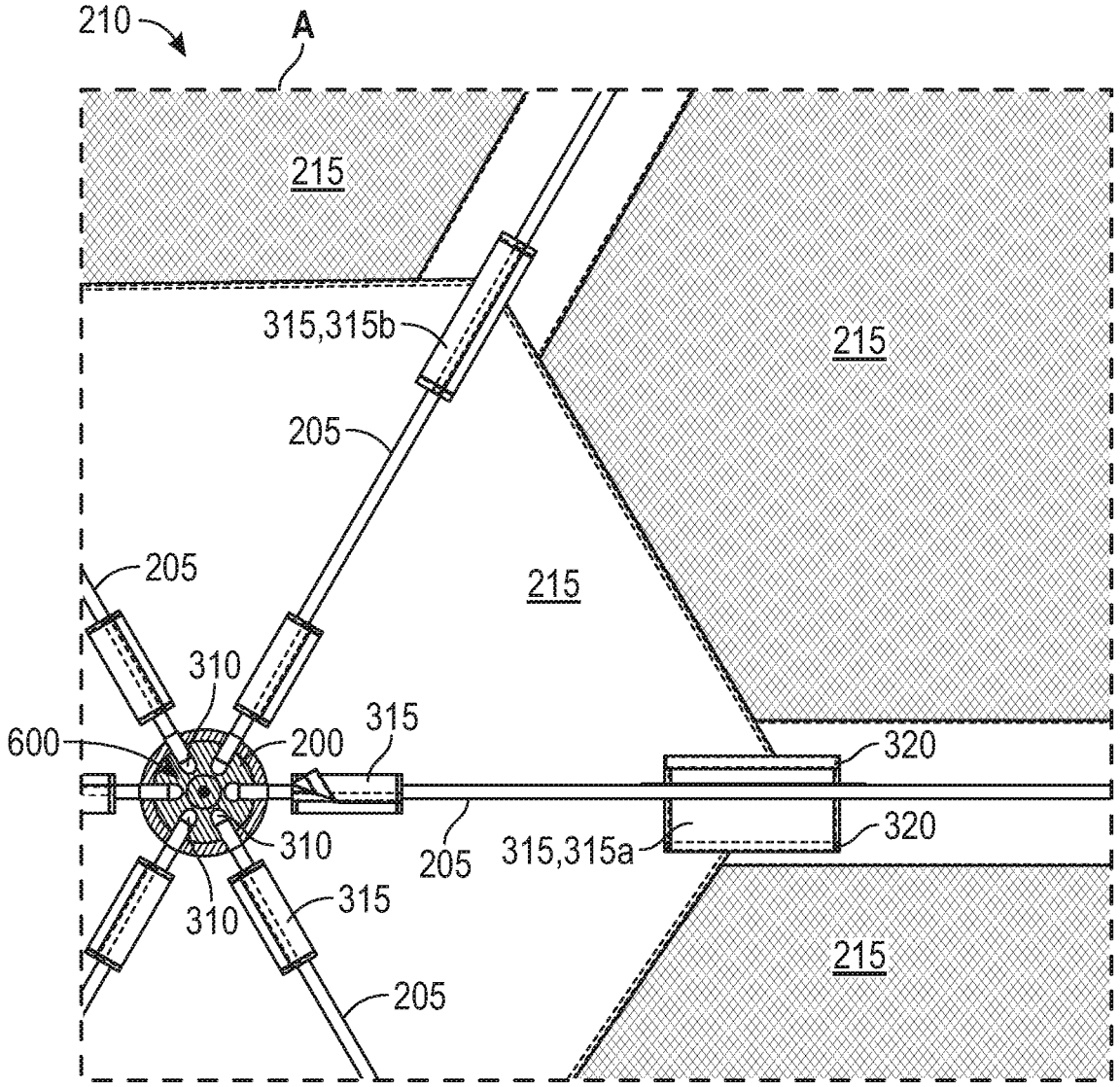
FIG. 3B illustrates a detailed partially schematic top view of the portion of FIG. 3A indicated as section "A"

FIG. 3B illustrates a detailed partially schematic top view of the portion of FIG. 3A indicated as section "A." With reference to FIGS. 3A and 3B, in some embodiments, the roof panel 210 includes attachment devices 315 for connecting the roof pole structures 205 to the roof panel 210 at one or more locations between the radially outward ends 305 and the radially inward ends 310. The attachment devices 315 can include any suitable sleeve, hook, latch, or other structure capable of suspending the roof panel 210 from the roof pole structures 205. For example, in some embodiments, and as shown in FIGS. 3A and 3B, the attachment devices 315 may include sleeves attached to the roof panel 210.

In some embodiments, one or more of the sleeves may optionally be opened or closed but, in other embodiments, one or more of the sleeves may not be openable. FIG. 3B shows an attachment device 315*a* in the form of a sleeve, which is opened to facilitate placement of the pole structure 205. The attachment devices 315 can include a connection device 320 for selectively opening or closing the attachment devices 315 around the pole structures 205. The connection device 320 can include a hook-and-loop connection between opposing sides of the attachment devices (sleeves) 315. In some embodiments, the connection device 320 can include other connections between the ends of the attachment devices 315. FIG. 3B also shows an attachment device 315*b* closed to restrain the pole structure 205.

Figure 3C:
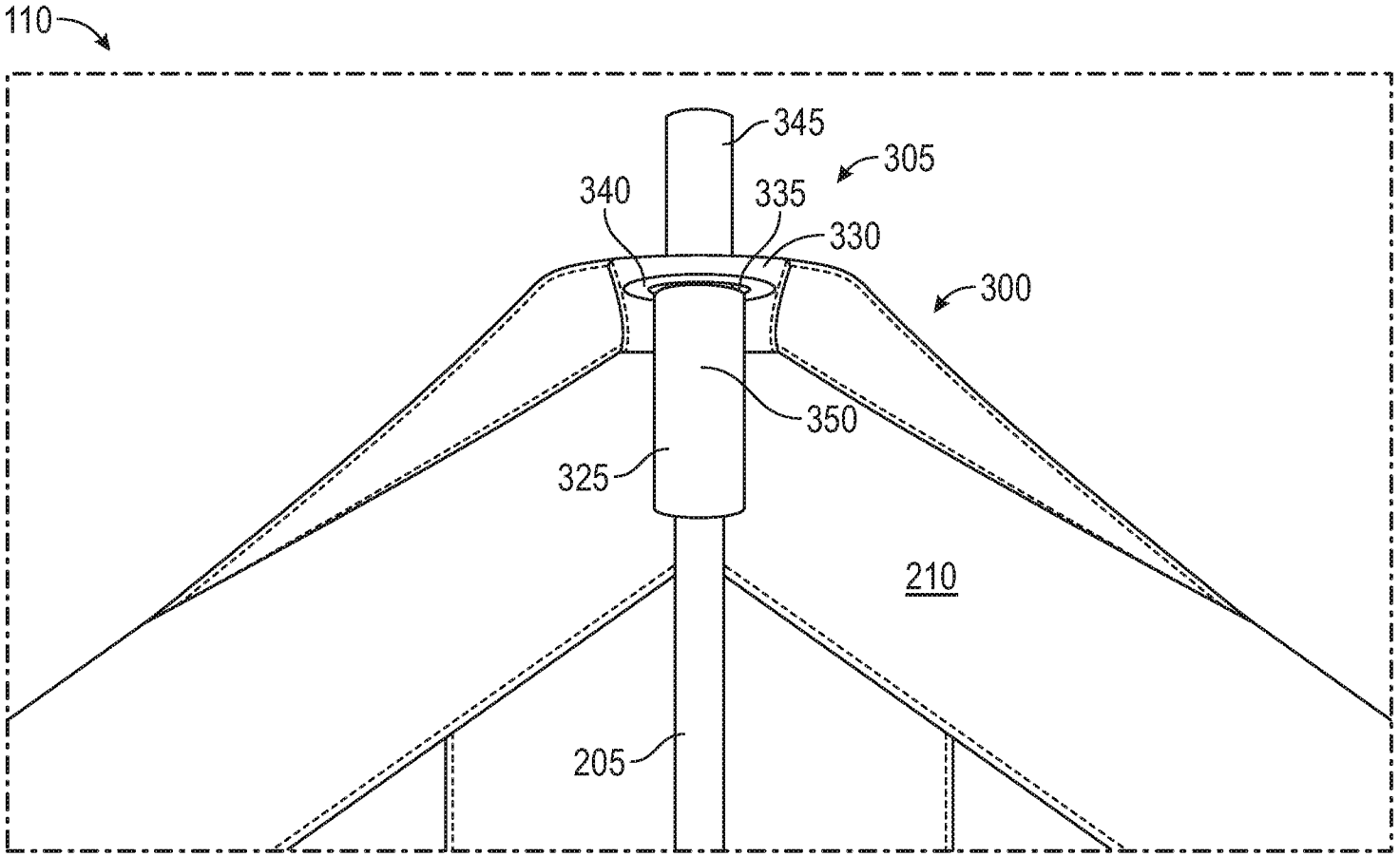
FIG. 3C illustrates a top view of a portion of the roof structure shown in FIGS. 2 and 3A.

FIG. 3C illustrates a top view of a portion of the roof structure 110 shown in FIGS. 2 and 3A. In some embodiments, the outward end 305 of each pole structure 205 may include or carry an engagement structure 325 for connecting the outward end 305 to the perimeter support 300 in a manner that facilitates providing tension on the roof panel 210 with the pole structure 205. For example, in some embodiments, a representative perimeter support 300 may include a flap element 330 with a hole 335 therethrough. The hole 335 may optionally include a grommet 340 to support the material that forms the flap element 330 (which can include the material that forms the roof panel 210, or another suitable material). In some embodiments, the engagement structure 325 may include a first portion 345 extending from a second portion 350. The second portion 350 may have a width that is greater than a width of the hole 335 so that the second portion 350 (and, consequently, portions of the pole structure 205 inward from the second portion 350) cannot pass through the hole 335. The first portion 345 may have a width that is smaller than the width of the hole 335 so that it can pass into the hole 335. Accordingly, the outward end 305 of the pole structure 205 engages the perimeter support 300 to support the roof structure 110.

Figure 4:
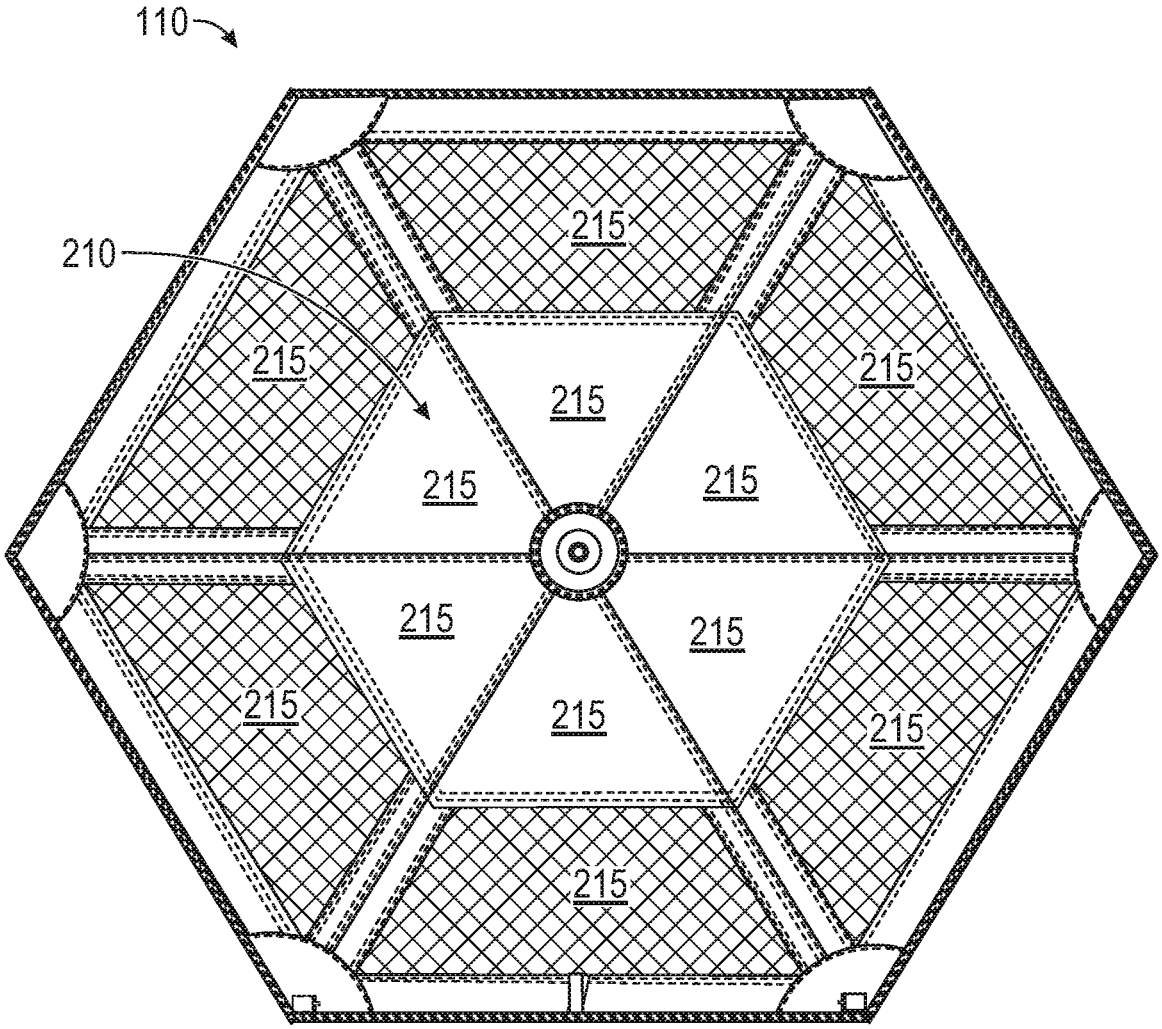
FIG. 4 illustrates a partially schematic bottom view (the perspective is from the interior of the shelter) of the roof structure shown in FIGS. 1 and 2.

FIG. 4 illustrates a partially schematic bottom view (the perspective is from the interior of the shelter 100) of the roof structure 110 shown in FIGS. 1 and 2, in the deployed configuration. One or more of the roof panel portions 215 may include mesh or perforated fabric with openings to facilitate airflow through the roof panel 210.

Figure 5A:
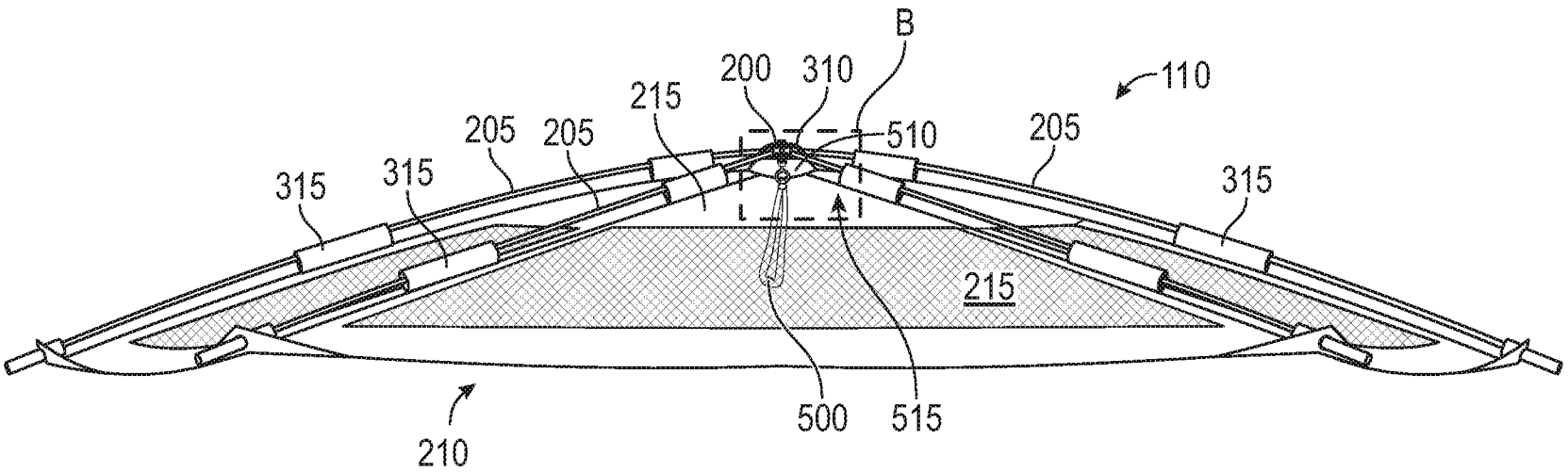
FIG. 5A illustrates a partially schematic side view of the roof structure shown in FIGS. 1 and 2.

FIG. 5A illustrates a partially schematic side view of the roof structure 110 shown in FIG. 2. When the roof structure 110 is in a deployed position, the hub structure 200 and the roof pole structures 205 are exterior to the shelter. The roof panel 210 is suspended below, and spaced apart from, the roof pole structures 205 via the attachment devices 315 (for example, sleeves). Positioning the roof pole structures 205 outside of the shelter and spaced apart from the roof panel 210 provides a gap between the optional rainfly 125 and the roof panel 210 to facilitate airflow between the roof panel 210 and the rainfly 125, because the rainfly 125 rests atop the roof pole structures 205 (see FIG. 1). In some embodiments, the roof structure 110 includes a pull handle 500 to facilitate stowing the roof structure 110, as described in detail below.

Figure 5B:
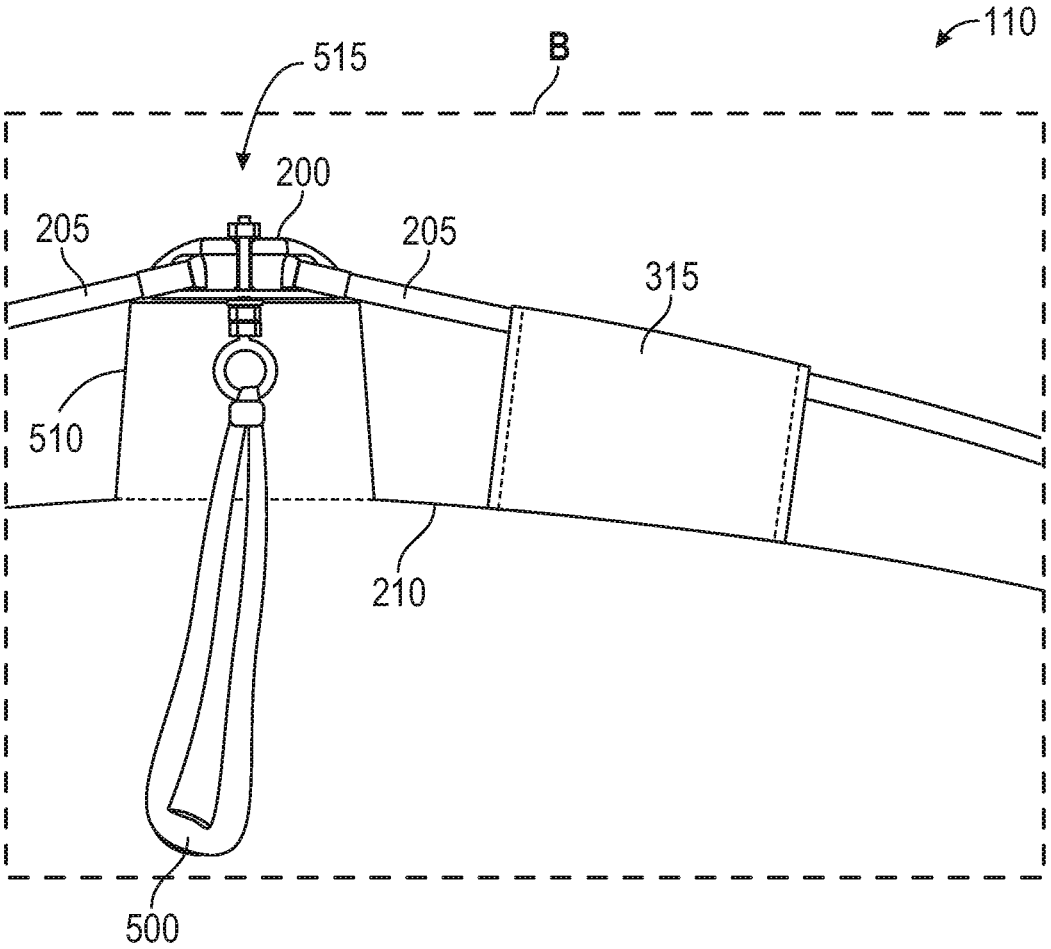
FIG. 5B illustrates a partially schematic detailed side view of the portion of FIG. 5A indicated as section "B"

FIG. 5B illustrates a partially schematic detailed side view of the portion of FIG. 5A indicated in FIG. 5A as section "B." Positioning the roof pole structures 205 on the exterior (top) side of the roof panel 210 and spaced apart from the roof panel 210 presents two challenges. First, in the deployed configuration (as shown in FIGS. 5A and 5B), the roof panel 210 needs to be supported with sufficient tension to form the roof structure 110 without bunching, slack, or damaging stresses on the roof panel 210. Second, the roof pole structures 205 need clearance to fold inwardly toward the stowed configuration without tearing the roof panel 210 when the roof structure 110 is pulled downwardly with the pull handle 500 (as described below with regard to FIGS. 6A and 6B).

To resolve these challenges, and to provide proper tension and alignment of the components of the roof structure 110, the roof structure 110 includes a receptacle, pouch, compartment, pocket, or other suitable extension 510 in the roof panel 210 configured to receive the hub structure 200 and the radially inward ends 310 of the roof pole structures 205 when the roof structure 110 is pulled down. For ease of description, the receptacle, pouch, compartment, pocket, or other suitable extension 510 is referred to herein simply as a "pocket" 510. The pocket 510 helps space apart the hub structure 200 from the remainder of the roof panel 210 to assist with maintaining tension in the roof panel 210—while not overly tensioning the roof panel 210—when the shelter 100 is stowed and deployed. In some embodiments, the pocket 510 is positioned at or generally near a geometric center 515 of the roof panel 210, although, in other embodiments, the pocket 510 may be positioned in other suitable locations where a hub structure 200 may be concentric with the pocket 510 or where the hub structure 200 can enter the pocket 510 during storage of the roof structure 110. A user can pull the pull handle 500 to flex the roof structure 110 downwardly to allow the roof structure to collapse into a stowable configuration.

Figure 6A:
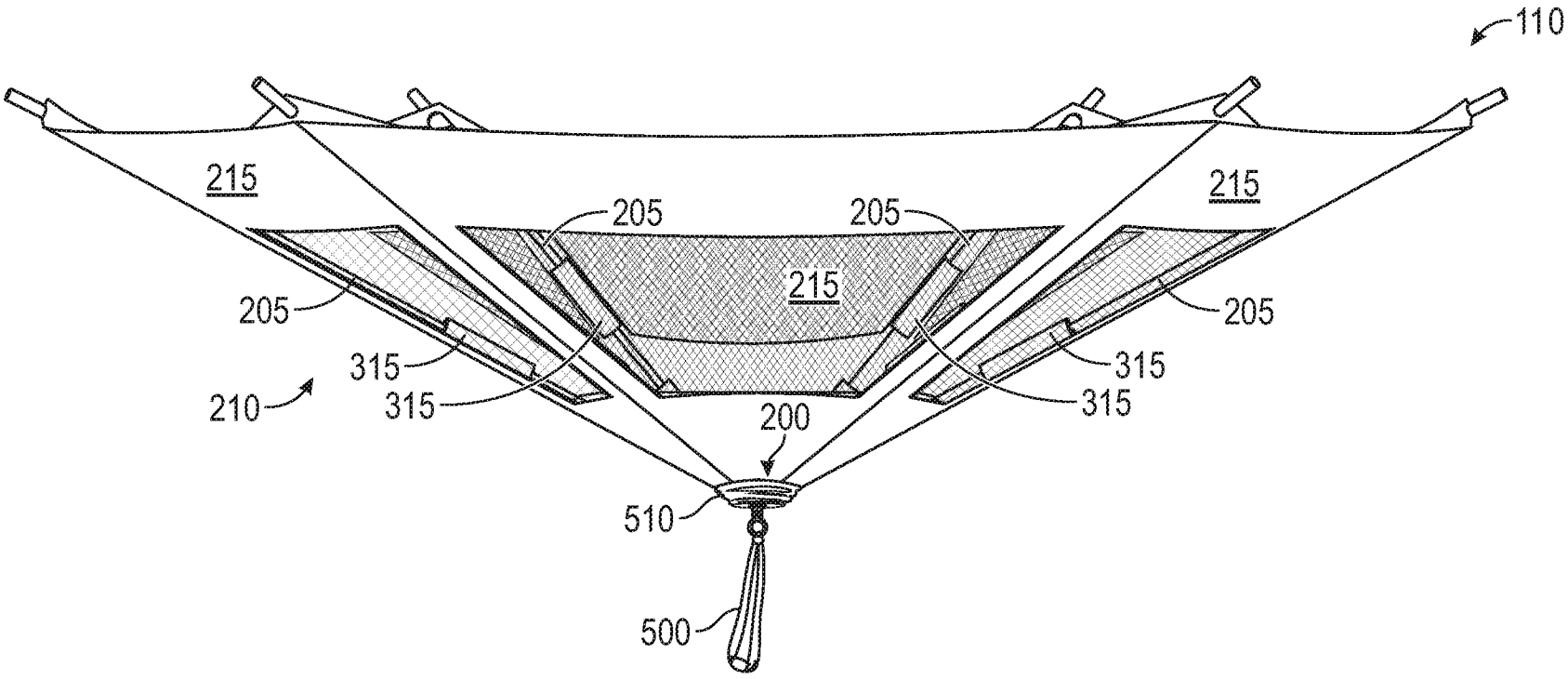
FIG. 6A illustrates a partially schematic side view of the roof structure shown in FIGS. 1 and 2, in a partially stowed configuration, in which a hub structure has been pulled down toward the ground (for example, via a pull handle)

FIG. 6A illustrates a partially schematic side view of the roof structure 110 in a partially stowed configuration, in which the hub structure 200 has been pulled down toward the ground (for example, via the pull handle 500). The hub structure 200 is generally indicated, but not visible, in FIG. 6A because it is pulled down into the pocket 510. As shown in the various figures, in some embodiments, the pocket 510 may be reversible. The pocket 510 provides relief for the geometry of the roof pole structures 205 as the roof structure 110 is pulled downward for stowage (or pushed upward for deployment). Without the pocket 510, the hub structure 200 and the roof pole structures 205 would stress the center of the roof panel 210, potentially tearing it. Inclusion of the pocket 510 prevents this damage and makes storage more space-efficient.

Figure 6B:
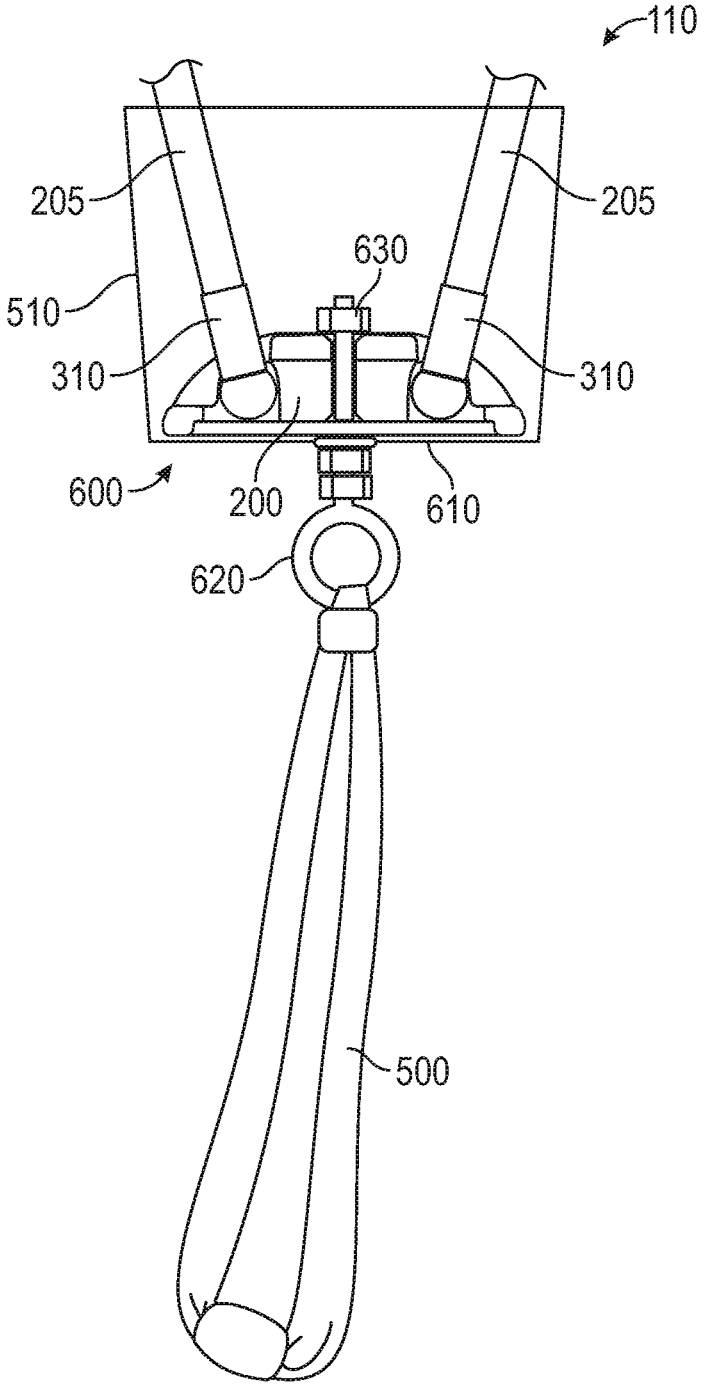
FIG. 6B illustrates a partially schematic detailed side view of the hub structure and some of the related components of the roof structure in an at least partially stowed configuration.

FIG. 6B illustrates a partially schematic detailed side view of the hub structure 200 and some of the related components of the roof structure 110. In FIG. 6B, the roof structure 110 is in an at least partially stowed configuration like FIG. 6A. Comparing FIGS. 5B and 6B reveals the reversible nature of the pocket 510, which can extend upwardly when the roof structure 110 is deployed, and which can extend downwardly when the roof structure 110 is stowed.

In some embodiments, the roof pole structures 205 are pivotably connected to the hub structure 200 by a suitable connection, such as a ball and socket joint 600. The hub structure 200 is attached to a middle portion 610 of the pocket 510. In some embodiments, a fastener 620, which can include an eye bolt as shown in FIG. 6B, passes through the middle portion 610, through the hub structure 200, and threads into a nut 630. In some embodiments, the hub structure 200 may include threads and the fastener 620 may be directly engaged with the threads of the hub structure 200. In general, the engagement between the fastener 620 (which is interior to the shelter 100 or otherwise below the roof panel 210) and the hub structure 200 (which is on the exterior side of the roof panel 210) attaches the hub structure 200 to the middle portion 610 of the pocket 510. In some embodiments, the pull handle 500 is attached to the fastener 620 (for example, via the loop of an eye bolt as shown). Pulling the fastener 620 (for example, via the pull handle 500) pulls the hub structure 200 downward against the pocket 510.

Figure 6C:
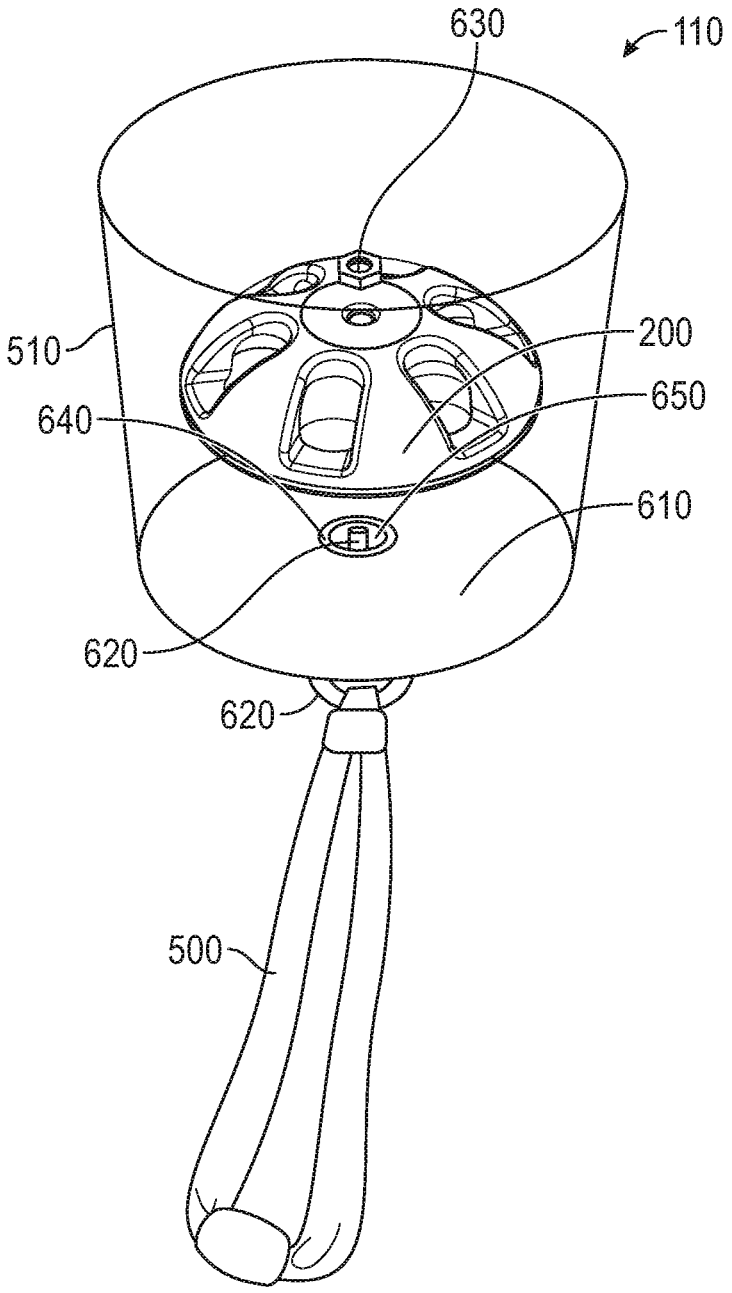
FIG. 6C illustrates a partially schematic perspective exploded view of the hub structure shown in FIG. 6B and some of the related components of the roof structure.

FIG. 6C illustrates a partially schematic perspective exploded view of the hub structure 200 and some of the related components of the roof structure 110. FIG. 6C illustrates the attachment between the pocket 510, the hub structure 200, and the optional pull handle 500. In some embodiments, the roof structure 110 includes a grommet 640 in the middle portion 610 to support an opening 650 through which the fastener 620 passes.

Figure 7:
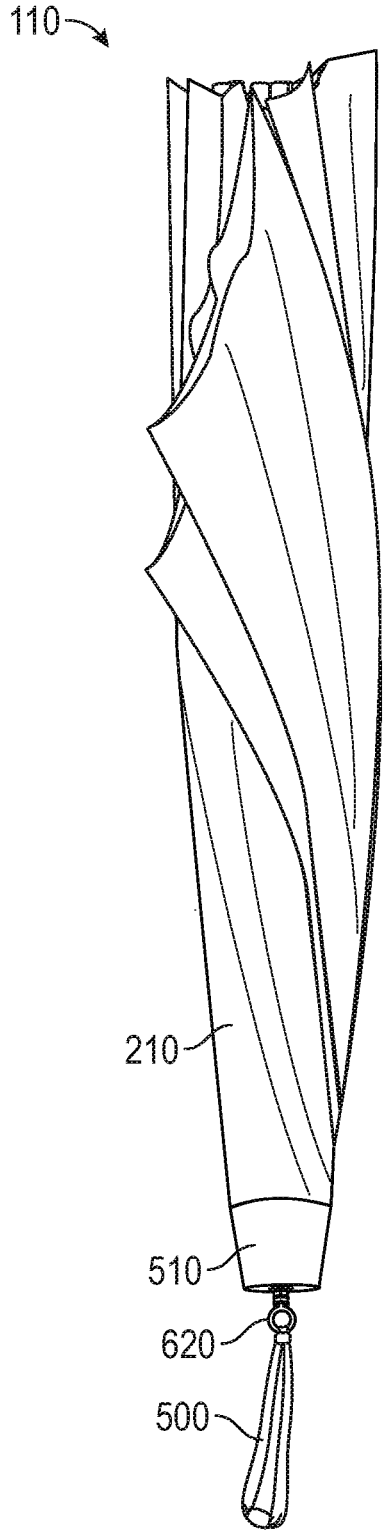
FIG. 7 illustrates a partially schematic side view of at least a portion of the roof structure shown in FIGS. 1 and 2 in a stowed configuration (for example, the pull handle has been pulled downward)

FIG. 7 illustrates a partially schematic side view of the roof structure 110 in a stowed configuration, in which the pull handle 500 has been pulled downward. The roof pole structures 205 (not visible) and the roof panel 210 are radially inwardly collapsed together. The pocket 510 allows the hub structure 200 and the radially inward ends 310 of the roof pole structures 205 to extend beyond what would otherwise have been a restrictive center area of the roof panel 210, as also shown in FIG. 6B.

Figure 8A:
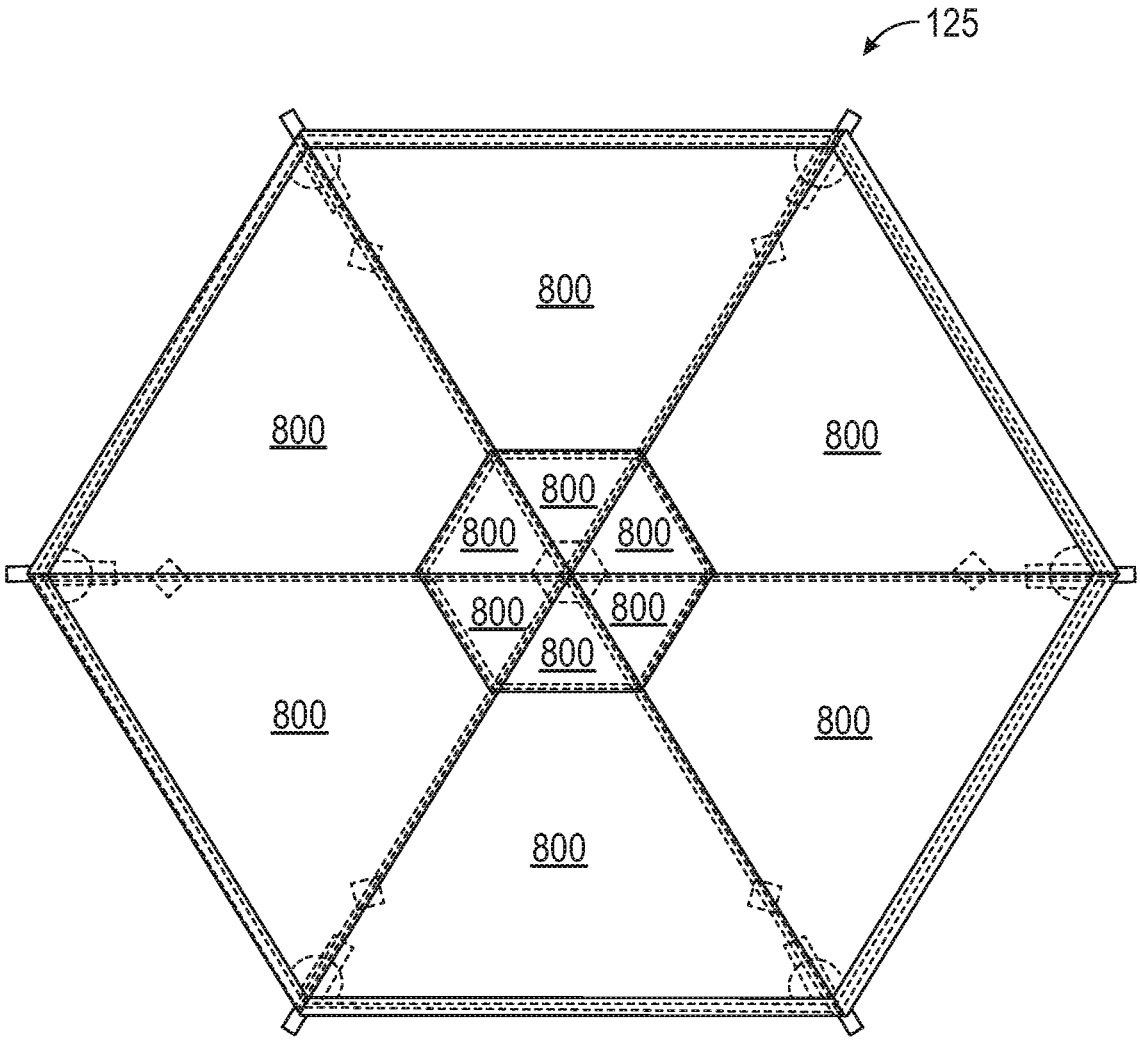
FIGS. 8A and 8B illustrate partially schematic top (exterior perspective) and bottom (opposite the top) views of the optional rainfly shown in FIG. 1, respectively.
Figure 8B:
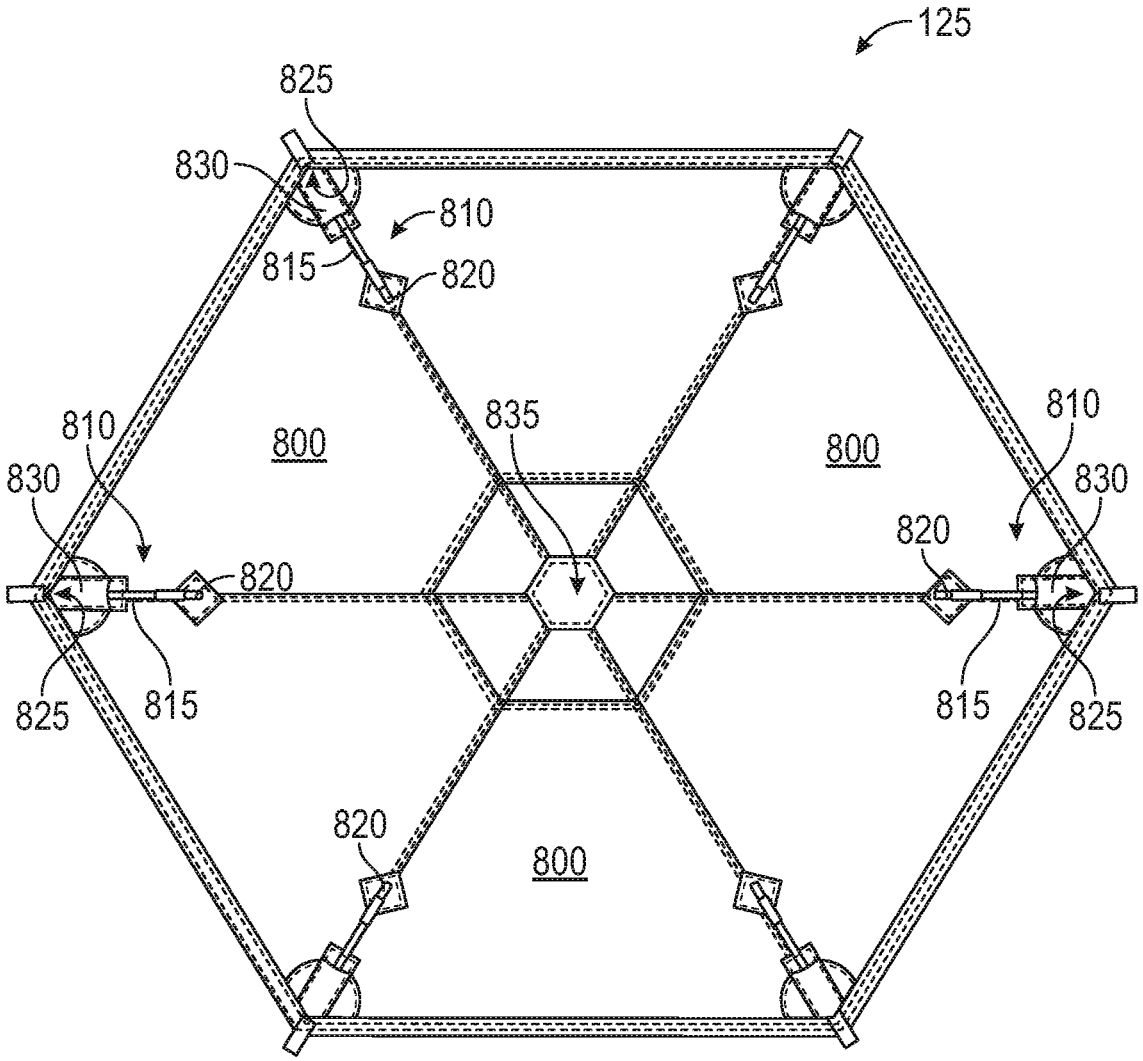

FIGS. 8A and 8B illustrate partially schematic top (exterior) and bottom views of the optional rainfly 125, respectively. In some embodiments, the rainfly 125 may include a plurality of connected rainfly panel portions 800. In some embodiments, the rainfly 125 includes a single integral panel.

With reference to FIG. 8B, in some embodiments, the rainfly 125 includes attachment elements 810 for connecting the rainfly 125 to the remainder of the roof structure 110. In some embodiments, the attachment elements 810 include rainfly pole structures 815 with radially inward ends 820 and radially outward ends 825. The radially outward ends 825 may be positioned in pockets 830 of the rainfly 125 or may otherwise be suitably attached or connected to the rainfly 125. The radially inward ends 820 may be positionable to project toward a center region 835 of the rainfly 125. In some embodiments, the attachment elements 810 may include other suitable attachment structures, such as clips, latches, or other devices to attach the rainfly 125 to the remainder of the roof structure 110 (above the roof pole structures 205).

Figure 9:
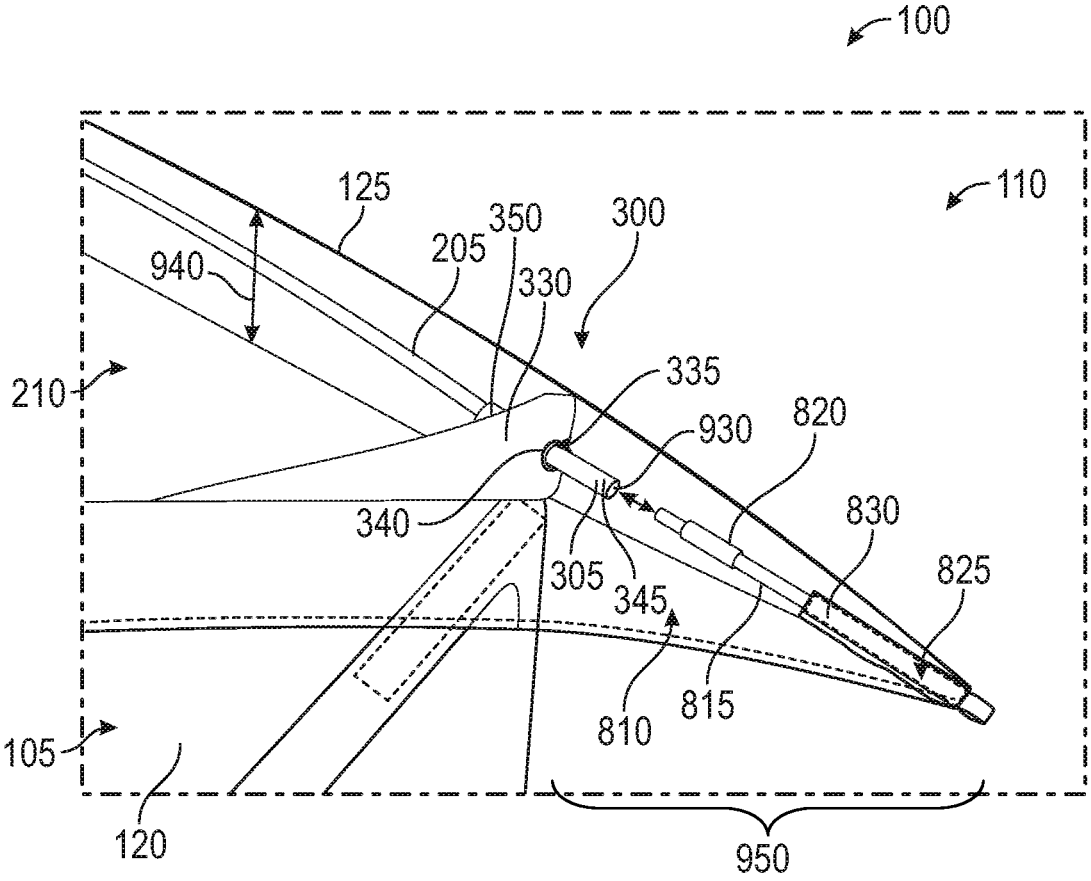
FIG. 9 illustrates a partially schematic detailed perspective view of a portion of the roof structure shown in FIG. 1, in which a representative rainfly is at least partially installed on a deployed roof structure.

FIG. 9 illustrates a partially schematic detailed perspective view of a portion of the roof structure 110, in which the rainfly 125 is at least partially installed. The radially outward ends 305 of the roof pole structures 205 may be connectable with the radially inward ends 820 of the rainfly pole structures 815. For example, in some embodiments, each radially outward end 305 of the roof pole structures 205 may include a socket 930 for concentrically receiving a corresponding radially inward end 820 of a rainfly pole structure 815. In a specific example, the first portion 345 of the engagement structure 325 may include the socket 930. In some embodiments, each rainfly pole structure 815 may include the socket, and each socket may concentrically receive a corresponding radially outward end 305 of the roof pole structure 205 (such as the first portion 345). When the roof pole structures 205 are connected to the rainfly pole structures 815, the rainfly 125 is generally taut and spaced apart from (above) the roof panel 210, thereby allowing airflow between the rainfly 125 and the roof panel 210. A gap 940 shown in FIG. 9 illustrates the space between the roof panel 210 and the rainfly 125.

In operation, a user may deploy or construct the base structure 105 using any suitable methods. In some embodiments, the user may position the roof pole structures 205 in their respective attachment devices 315 (such as sleeves)

and connect the roof pole structures 205 to their respective perimeter supports 300 and to the hub structure 200 to form the roof structure 110. In some embodiments, the user may deploy the roof structure 110 from the elongated stowed configuration illustrated in FIG. 7 and position the roof structure 110 on the base structure 105. When the roof structure 110 is in the elongated stowed configuration in FIG. 7, the pocket 510 receives the hub structure 200 and accommodates the additional length of the roof pole structures 205 that would not fit if there were no pocket 510. In some embodiments, the user may "pop" the roof structure 110 up from the partially deployed configuration shown in FIG. 6A, until the roof structure 110 is in the deployed configuration shown in FIGS. 2, 5A, and 5B. When the roof structure 110 is in the deployed configuration, the pocket 510 allows the hub structure 200 and the roof pole structures 205 to be elevated above (spaced apart from) the roof panel 210. As a result, when the user positions the rainfly 125 over the roof pole structures 205, the space allows ventilation and airflow.

Advantages of the present technology may include a reduced quantity of components needed at an assembly site relative to conventional shelters. For example, in some embodiments, the user need only deploy the base structure 105, pop up the roof structure 110, and attach the optional rainfly 125. Similarly, when stowing the shelter 100, the user may detach the rainfly 125, pull the pull handle 500 to pop the roof structure 110 down, and stow the roof structure 110 or the base structure 105. The pocket 510 facilitates more compact stowage of the roof structure 110 by accommodating the extra length of the roof pole structures 205 resulting from the geometry of spacing the roof pole structures 205 from the roof panel 210.

Various suitable materials may be used to form the various components of the shelter 100 or the roof structure 110. Rigid or generally rigid components such as the hub structure 200, or portions of roof pole structures 205, may include composite materials such as high-stiffness fiberglass or carbon fiber, high-stiffness plastic materials, metal materials, or other suitable materials. In some embodiments, the roof pole structures 205 may include semi-flexible materials to facilitate resilient flexibility during stowage and deployment. Fabric materials may include any suitably flexible, breathable, weather-resistant, natural, or synthetic materials capable of use in the desired environment (such as outdoors).

Some embodiments of the present technology include kits of parts for assembling a roof structure or shelter. Further, the various parts and components disclosed herein may be connectable together to form systems, subassemblies, or assemblies configured in accordance with embodiments of shelters and roof structures disclosed herein. Kits of parts or systems may include some or all of the elements of a roof structure or shelter described herein. For example, a kit of parts or a shelter system may include a plurality of roof pole structures 205, a hub structure 200, a roof panel 210 (or a plurality of roof panel portions 215 configured to be connected together to form a roof panel 210), a plurality of attachment devices 315, or other components or combinations of components disclosed herein. A kit of parts or a shelter system may include the base structure 105 or portions thereof. Although a roof structure is disclosed as an example embodiment, in some embodiments, the structure may include a wall structure such that the hub structure 200, roof pole structures 205, and roof panel 210 (with the pocket 510) are oriented generally vertically, such that the roof panel 210 functions as a wall panel.

Embodiments of the present technology include portable shelters (such as tents, blinds, gazebos, partitions, or other shelter structures) that may be assembled, disassembled, stowed, or deployed using fewer components and process steps than conventional shelters. In particular, embodiments of the present technology facilitate spacing a rainfly 125 away from a roof panel 210 to provide a gap for airflow between the roof panel 210 and the rainfly 125, while still providing a sufficiently taut and stowable roof structure 110.

From the foregoing, it will be appreciated that specific embodiments of the presently disclosed technology have been described herein for purposes of illustration, but that various modifications may be made without deviating from the scope of the technology. For example, although a six-sided base structure is shown (along with other elements generally forming a six-sided structure), embodiments of the present technology may include any suitable number of sides, poles, roof panel portions, and other components. Other embodiments may include other manners of connection between the rainfly 125 and the other components of the roof structure 110.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A shelter comprising:

a base structure comprising a plurality of walls that are positionable to at least partially enclose an interior region of the shelter; and a roof structure positionable to be supported above a ground surface by the base structure;

wherein the roof structure comprises:

a fabric panel;

a pocket in the fabric panel;

a hub structure, wherein the pocket is positionable to receive the hub structure, and wherein the hub structure is attached to the pocket via a fastener that extends from the hub structure, through a portion of the pocket, and into the interior region of the shelter; and a plurality of roof pole structures, wherein each roof pole structure is connectable to the hub structure to extend outwardly from the hub structure toward a perimeter of the roof structure, and wherein each roof pole structure is positionable outside of the interior region of the shelter;

wherein the roof structure is configurable between a stowed configuration and a deployed configuration, wherein when the roof structure is in the stowed configuration, the hub structure is positioned in the pocket, and when the roof structure is in the deployed configuration, the hub structure is positioned above or outside of the pocket and the pocket extends upwardly and spans all of a distance between the hub structure and the remainder of the fabric panel.

2. The shelter of claim 1, wherein the pocket is a reversible pocket.

3. The shelter of claim 1, further comprising a plurality of attachment devices positionable to connect the roof pole structures to the fabric panel, to space the roof pole structures apart from at least a portion of the fabric panel to form a gap between the roof pole structures and the fabric panel, and to suspend the fabric panel below the roof pole structures.

4. The shelter of claim 3, wherein the attachment devices comprise sleeves.

5. The shelter of claim 4, wherein the sleeves are openable and closeable via connection devices.

6. The shelter of claim 1, further comprising a rainfly, wherein the rainfly is positionable over the fabric panel and over the roof pole structures.

7. The shelter of claim 6, further comprising a plurality of rainfly pole structures connectable to the rainfly, wherein the rainfly pole structures are connectable to the roof pole structures.

8. The shelter of claim 1, wherein the fabric panel comprises one or more fabric panel portions that include a mesh material.

9. The shelter of claim 1, further comprising a pull handle connected to the fastener.

10. The shelter of claim 1 wherein the base structure comprises a frame structure to support the walls.

11. The shelter of claim 1, wherein the fastener comprises a bolt having a loop portion, wherein the loop portion is positioned in the interior region of the shelter.

12. The shelter of claim 1, wherein the pocket comprises a middle portion and a tubular extension connecting the middle portion to the remainder of the fabric panel.

13. The shelter of claim 12, wherein the middle portion spans a full distance between the hub structure the remainder of the fabric panel.

14. A shelter system comprising a roof structure, the roof structure comprising:

a hub structure;

a plurality of roof pole structures connectable to the hub structure and positionable to extend outwardly from the hub structure; and a fabric panel configured to be at least partially suspended from the roof pole structures, wherein the fabric panel comprises a pocket attached to the hub structure;

wherein the roof structure is configurable between a stowed configuration and a deployed configuration, wherein when the roof structure is in the stowed configuration, the hub structure and at least a portion of each roof pole structure are positioned in the pocket, and when the roof structure is in the deployed configuration, the pocket comprises a tubular shape and the hub structure is positioned above or outside of the pocket.

15. The shelter system of claim 14, further comprising a plurality of attachment devices to connect the fabric panel to the roof pole structures.

16. The shelter system of claim 15, wherein the attachment devices comprise one or more sleeves.

17. The shelter system of claim 14, further comprising a rainfly, wherein the rainfly is positionable over the fabric panel and over the roof pole structures to form a gap between the rainfly and the fabric panel.

18. The shelter system of claim 17, further comprising a plurality of rainfly pole structures connectable to the rainfly, wherein the rainfly pole structures are connectable to the roof pole structures.

19. The shelter system of claim 14, further comprising a base structure, wherein the base structure supports the roof structure.

20. The shelter system of claim 19, wherein the base structure comprises one or more walls.

21. The shelter system of claim 14, wherein the pocket is a reversible pocket.

22. A shelter comprising:

a base structure comprising a plurality of walls that are positionable to at least partially enclose an interior region of the shelter; and a roof structure positionable to be supported above a ground surface by the base structure;

wherein the roof structure comprises:

a fabric panel;

a pocket in the fabric panel;

a hub structure, wherein the pocket is positionable to receive the hub structure, and wherein the hub structure is attached to the pocket via a fastener that extends from the hub structure, through a portion of the pocket, and into the interior region of the shelter, wherein the fastener comprises a bolt having a loop portion positioned in the interior region of the shelter; and a plurality of roof pole structures, wherein each roof pole structure is connectable to the hub structure to extend outwardly from the hub structure toward a perimeter of the roof structure, and wherein each roof pole structure is positionable outside of the interior region of the shelter;

wherein the roof structure is configurable between a stowed configuration and a deployed configuration, wherein when the roof structure is in the stowed configuration, the hub structure is positioned in the pocket, and when the roof structure is in the deployed configuration, the hub structure is positioned above or outside of the pocket.

23. The shelter of claim 22, further comprising a plurality of attachment devices positionable to connect the roof pole structures to the fabric panel, to space the roof pole structures apart from at least a portion of the fabric panel to form a gap between the roof pole structures and the fabric panel, and to suspend the fabric panel below the roof pole structures.

24. The shelter of claim 22, further comprising a pull handle connected to the loop.

25. The shelter of claim 22, wherein when the roof structure is in the deployed configuration, the pocket extends upwardly and spans between the hub structure and the remainder of the fabric panel.

26. The shelter of claim 22, wherein the pocket comprises a tubular shape when the roof structure is in the deployed configuration.

27. A shelter comprising:

a base structure comprising a plurality of walls that are positionable to at least partially enclose an interior region of the shelter; and a roof structure positionable to be supported above a ground surface by the base structure;

wherein the roof structure comprises:

a fabric panel;

a pocket in the fabric panel, wherein the pocket comprises a middle portion and a tubular extension connecting the middle portion to the remainder of the fabric panel;

a hub structure, wherein the pocket is positionable to receive the hub structure, and wherein the hub structure is attached to the pocket via a fastener that extends from the hub structure, through a portion of the pocket, and into the interior region of the shelter; and a plurality of roof pole structures, wherein each roof pole structure is connectable to the hub structure to extend outwardly from the hub structure toward a perimeter of the roof structure, and wherein each roof pole structure is positionable outside of the interior region of the shelter;

wherein the roof structure is configurable between a stowed configuration and a deployed configuration, wherein when the roof structure is in the stowed configuration, the hub structure is positioned in the pocket, and when the roof structure is in the deployed configuration, the hub structure is positioned above or outside of the pocket.

28. The shelter of claim 27, further comprising a plurality of attachment devices positionable to connect the roof pole structures to the fabric panel, to space the roof pole structures apart from at least a portion of the fabric panel to form a gap between the roof pole structures and the fabric panel, and to suspend the fabric panel below the roof pole structures.

29. The shelter of claim 27, wherein the fastener comprises a bolt having a loop portion, wherein the loop portion is positioned in the interior region of the shelter.

* * * * *